United States Patent [19]

Graef et al.

[11] Patent Number: 4,494,747

[45] Date of Patent: Jan. 22, 1985

[54] PAPER CURRENCY DISPENSER FRICTION PICKER MECHANISM

[75] Inventors: Harry T. Graef, Massillon; Kevin H. Newton, North Canton, both of Ohio

[73] Assignee: Diebold, Incorporated, Canton, Ohio

[21] Appl. No.: 510,410

[22] Filed: Jul. 1, 1983

[51] Int. Cl.[3] ..... B65H 7/12

[52] U.S. Cl. ..... 271/263; 221/21; 221/251; 271/110; 271/120; 271/122

[58] Field of Search ..... 271/118, 122, 125, 263, 271/10, 110, 111, 114, 119, 120; 221/21, 231, 251

[56] References Cited

U.S. PATENT DOCUMENTS

| | | | |
|---|---|---|---|
| 1,174,391 | 3/1916 | Cartwright | 271/118 |
| 3,857,559 | 12/1974 | McInerny | 271/122 |
| 3,874,650 | 4/1975 | Strigerwald et al. | 271/118 |
| 3,908,982 | 9/1975 | Abe | 271/114 |
| 3,970,298 | 7/1976 | Irvine et al. | 271/122 |
| 4,154,437 | 5/1979 | Burcheck et al. | 271/6 |
| 4,158,456 | 6/1979 | Holland-Letz | 271/118 |
| 4,159,782 | 7/1979 | Swartzendruber | 271/122 |
| 4,208,046 | 6/1980 | Shimizu | 271/122 |
| 4,232,860 | 11/1980 | Brown | 271/119 |
| 4,239,203 | 12/1980 | Uchida | 271/122 |
| 4,355,797 | 10/1982 | Graef et al. | 271/20 |

*Primary Examiner*—Bruce H. Stoner, Jr.
*Assistant Examiner*—John A. Carroll
*Attorney, Agent, or Firm*—Frease & Bishop

[57] ABSTRACT

The device has a feed roller with a high friction rubber segment which picks notes one at a time for each roller revolution or cycle. A counter-rotating separator roller normally prevents picking doubles. A cooperative doubles detector detects doubles when picked and returns the doubles to the note supply stack. The picker mechanism has a biasing lever which holds the note stack out of contact with the feed roller against stack pressure until the friction segment is in note separating and picking position.

21 Claims, 22 Drawing Figures

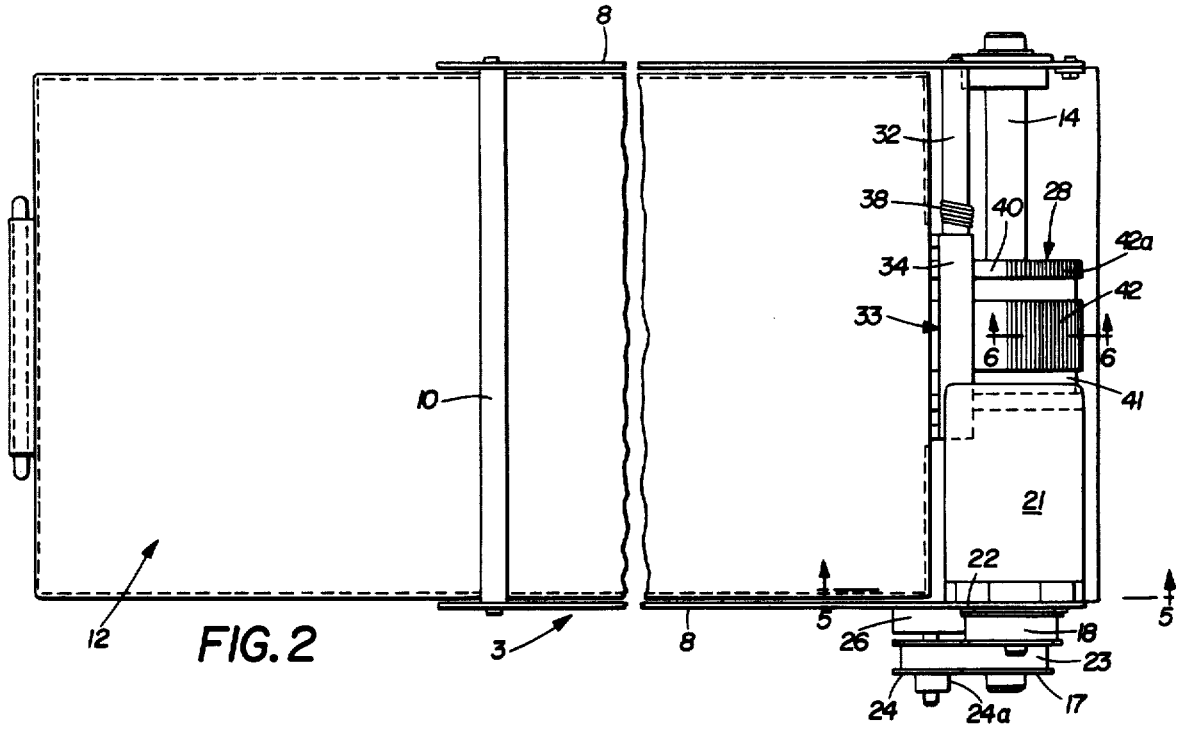
FIG. 2
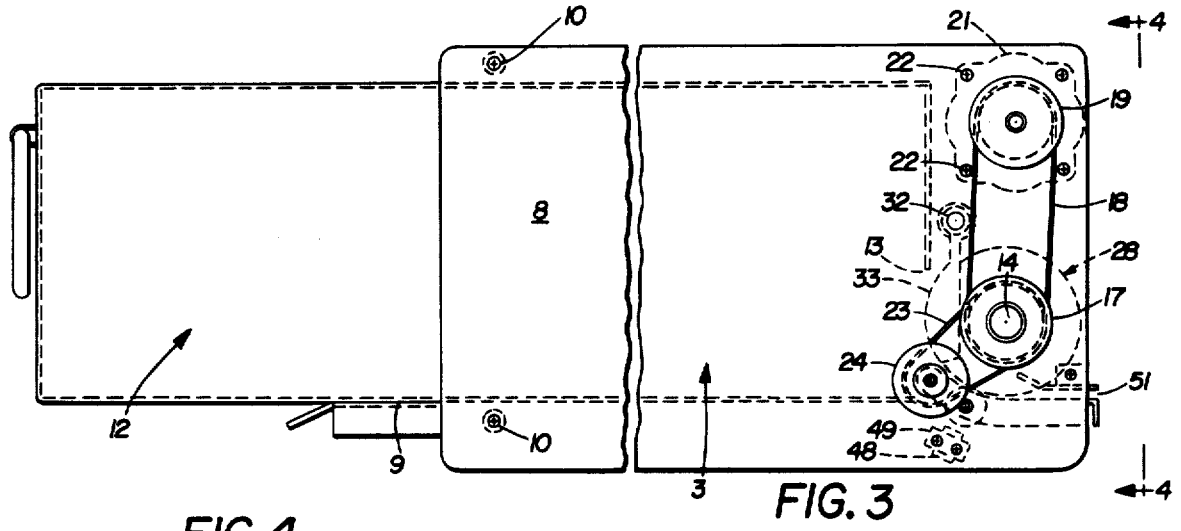
FIG. 3
FIG. 4
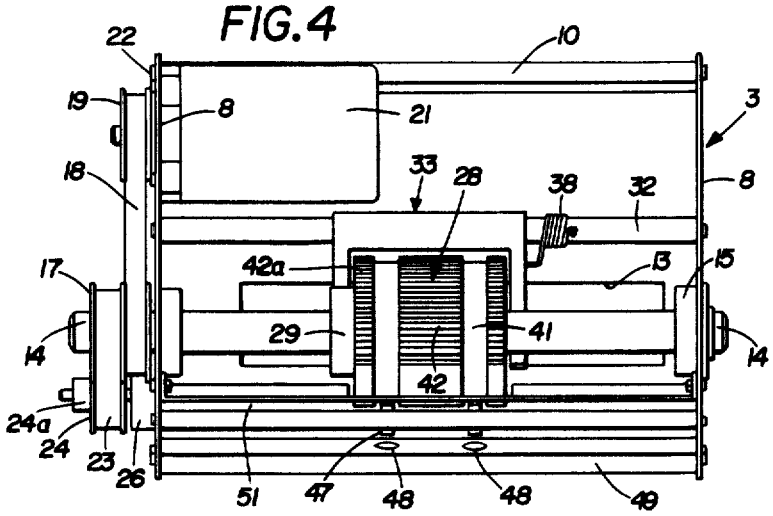
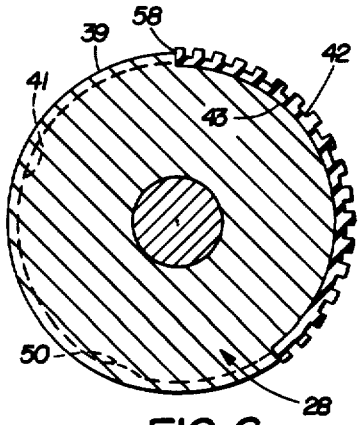
FIG. 6

PAPER CURRENCY DISPENSER FRICTION PICKER MECHANISM

CROSS-REFERENCE TO RELATED PATENTS AND APPLICATION

The improved friction picker mechanism of the invention constitutes improvements on the devices disclosed in U.S. Pat. No. 4,154,437, dated Mar. 15, 1979, and No. 4,355,797, dated Oct. 26, 1982; and may incorporate Method of and System for Detecting Bill Status Such as Single Bill, Double Bills, and Folded or Overlapped Bills in a Paper Money Dispensing System, described in Graef et al. application Ser. No. 309,022, filed Oct. 5, 1981, now U.S. Pat. No. 4,462,587, dated July 31, 1984; all of said patents and application being owned by the Assignee of this application.

BACKGROUND OF THE INVENTION

1. Field of the Invention

The invention relates to an automatic banking or teller machine (ATM) and, more particularly, to ATMs which may be installed in free-standing locations either remote from central banks or at locations accessible to customers in or adjacent central banks for dispensing paper currency or notes of one or more denominations.

More particularly, the invention relates to a friction picker mechanism of simple construction for reliably feeding paper notes one at a time from a supply stack of notes.

Further, the invention relates to a new friction picker mechanism which eliminates complicated pneumatic or suction picker components and combines in the new simple and reliable friction picker device known doubles detecting components; which such combined friction picker mechanism eliminates diversion of doubles when detected from a path of travel to a note delivery station; which mechanism eliminates transport means for delivering detected doubles to a divert container; which mechanism eliminates a divert container for receiving detected doubles and security devices therefor; which mechanism eliminates belt conveyors or like transport devices as a part or component of the friction picker mechanism; and which mechanism permits delivery of picked notes being dispensed directly to a delivery station which may be an access opening in the fascia of an ATM.

Also the invention relates to a mechanism which simplifies note timing as a part of the feeding of notes one at a time from a note supply stack to a delivery station with controlled spacing of the notes more consistently than is present in prior ATM note dispensers.

In addition, the invention relates to a new friction picker mechanism concept wherein detected doubles are returned by the mechanism to the supply stack of notes for separation and redispensing.

Also the invention relates to a new friction picker mechanism characterized by simplifying servicing and maintenance because of the mechanism's simple and reliable construction and operation, all of which significantly reduce the costs of picker mechanism manufacture, repair and maintenance.

Finally, the invention relates to a new friction picker mechanism which is characterized by having all of the features described combined in a cooperative and interrelated manner.

2. Description of the Prior Art

Various types and kinds of picker mechanisms are known in various arts for feeding sheets, documents, currency and the like, from a stack thereof to another location. Traditionally, picker mechanisms for ATMs which pick notes from a stack and deliver the notes one at a time to a customer delivery station have been pneumatic or suction type picker devices, such as disclosed in Graef et al. U.S. Pat. No. 4,355,797 for example. Inherently such suction picker devices are complicated in construction and opration, they have many parts or components, and they may be relatively slow in operation. It is, thus, desirable to avoid the complicated structure and complicated and slow operation of suction picker devices.

Other sheet, document or currency picker devices have involved friction members which pull or wipe sheets from a stack thereof to feed the sheets to a downstream location. Still other picker devices include components which push the outer document from the stack to move a downstream end of the document to a feed roll stand. Sometimes the downstream end of the pushed document has been retarded to separate the document from the next document in the stack. This push-retard picker may be used where the paper or document is stiff and does not crumple under push-retard pressure. Such procedure cannot be used in picking paper notes since they are not stiff enough to avoid being crumped or crushed when handled by push-retard means.

Prior art patents showing various paper or sheet feeder or separator devices include U.S. Pat. Nos. 1,174,391, 4,208,046, 4,232,860 and 4,239,203. These devices include roll stands having circumferentially complete rubber or other similar frictional surfaces for feeding the articles being picked. In some instances one of a pair of friction surfaced rolls is a counter-rotating roll for separating the outer from the next document in a supply stack. Such types of paper or sheet feeders may not be reliably used for dispensing currency notes since they do not guard against the delivery of doubles.

Other prior suction or friction types of separators or feeders in the paper money dispensing field are shown in U.S. Pat. Nos. 4,154,437, 4,158,456 and 4,159,782 wherein the presence of doubles is detected. However, these devices require complicated assemblies and components. Belt conveyors are required as a part of the feeding and picking operation or for conveying doubles to a place of storage, and storage devices are also required for the diverted doubles.

Still another type of sheet separator and feeder mechanism used for feeding mixed thickness pieces, such as pieces of mail in the Postal Service, is shown in U.S. Pat. No. 3,970,298. In this device, a flexible belt strips the outer piece to be fed from the lower end of a stack of envelopes under pressure to push the piece forward where a counter-rotating roll retards such movement before the piece reaches a feed means roll stand including one of the belt conveyor rolls, to prevent the feeding of more than one piece. Here again a belt conveyor component is required as a part of the picking and feeding mechanism.

The prior art thus fails to provide a simple and reliable low cost friction picker mechanism for dispensing paper currency notes, or which eliminates the necessity of providing belt conveyors, or divert containers, or of diverting detected doubles from the note delivery path.

Further, the prior friction picker paper note dispensing art fails to provide a simple friction picker mechanism having a picker mechanism ordinarily operating with a reversely rotating friction roll or retarding device to separate the outer note of a supply stack from the next adjacent note during feeding, but which, in the event of separation failure, automatically returns the doubles to the stack.

Thus, a need has long existed in the banking field for a new type of picker mechanism for ATMs which is simple and low cost in construction, operation and maintenance, and which is reliable in feeding paper notes one at a time from a stack of notes directly to the customer delivery station.

SUMMARY OF THE INVENTION

It is an objective of the invention to providing a new friction picker mechanism with a minimum number of components which are simple in design and construction and which will reliably separate paper notes from a supply stack and feed such notes one at a time a delivery station. It is another object to provide such new picker mechanism with feed roller means having a preferably roughened or textured rubber frictional area arcuate segment extending partially circumferentially around the feed roller surface with the segment ends of the frictional area joined by a smooth low friction roller surface, wherein the arcuate length of the friction segment approximates the width or length of a note to be picked. Yet another object is the provision of such new picker mechanism in which friction rubber covered counter-rotatable rollers or other friction devices cooperatively associated with the feed roller engage the inside of a note being picked when the rubber friction segment engages the note to be picked, and continues to engage said inside note throughout feeding engagement and movement of the note by said friction segment, normally to separate the note being picked from the next bill in the stack. The invention has a further object to provide such new picker mechanism preferably with biasing lever means cooperatively associated with the feed roller to resist normal stack pressure and to hold the notes in the supply stack out of contact with the smooth surface portion of the feed roller until the leading end of the feed roller friction segment engages the counter-rotating note separating roller, at which time the biasing lever releases the stack so that the outer stack note is pressed by stack pressure against and contacts the feeder roller friction segment which picks or extracts said outer stack note from the stack and moves said note toward the ATM note delivery station. Another object is the provision of such new picker mechanism feed roller rubber friction surface segment with a note contact zone area greatly in excess of the note contact zone area of said counter-rotating roller rubber friction surface, with a greater segment diameter than the diameter of the counter-rotating roller, and with a segment speed of rotation preferably four to eight times that of the counter-rotating roller, so that when a note being picked from a supply stack by said feed roller and is moved between said rotating feed and counter-rotating rollers, the feed roller friction-engaging force overcomes the counter-rotating roller counter-friction-engaging force and picks and drives the outer stack note in the direction of feed roller movement. Still another object is to provide such new picker mechanism with drive means for rotating said feed and counter-rotating rollers, preferably a reversing stepper type motor. An additional object is to provide such new picker mechanism with doubles detect sensor means cooperatively associated with the feed and counter-rotating rollers so that if a doubles is fed by the feed roller and not separated by the counter-rotating roller the doubles detect means sensor automatically reverses the stepper drive motor for the feed and counter-rotating rollers to return the detected doubles to the stack. The providing of such new picker mechanism with means enabled by the return of the detected doubles to the stack to again initiate a feeding operation from the stack, and repeating the doubles return to and feeding from the stack until a single note is fed is a further object of the invention. The provision of such new picker mechanism in which a detected doubles after being repeatedly returned to and fed from the supply stack of notes a predetermined number of times may be dispensed in accordance with note status determination as a doubles in accordance with the system disclosed in said U.S. Pat. No. 4,462,587 is yet another object. It is another object to provide such new picker mechanism which eliminates the use of complicated suction picker devices, which eliminates equipment to divert detected doubles from the normal path of travel of notes being dispensed, which eliminates the provision or use of a divert container to receive and store diverted doubles, which eliminates the need for doubles transport means for conveying doubles to a divert container, and which eliminates the need for or use of transport conveyor means such as belt conveyors as a part of the picker mechanism, per se. A further object of the invention is the providing of such new picker mechanism with simplifies control of note timing as a part of one at a time note feeding to more easily control note spacing than in prior note feeders. Another object is to provide a new friction picker mechanism and mode of operation which achieve the stated objectives, which eliminate complicated structures, operations and maintenance involved in the use of prior picker mechanisms while providing reliable and effective operation, and which solve problems that have been encountered and satisfy needs that long have existed in the operation of prior picker mechanisms for ATMs.

These and other objectives and advantages may be obtained by the construction the general nature of which may comprise a friction picker mechanism for an ATM paper note dispenser of a type in which notes at the end of a note supply stack normally pressed toward said mechanism are separated and picked one at a time from said stack by associated friction areas of a rotatable feed roller and friction separator means when said roller is driven in note feeding direction by drive means; wherein the improvement comprises: a rotatable feed roller having a smooth cylindrical surface provided with arcuate rubber friction segment means interrupting said smooth surface; rubber friction separator means directed toward and free of contact with said feed roller; doubles detector means including note thickness gauging devices located adjacent said separator means and engaged with and actuated by notes as said notes are fed by said feed roller; reversible driven means operatively connected with said feed roller which drive means when energized normally drives said feed roller in note feeding direction with said friction segment means engaging and picking stack end notes and driving said notes one at a time successively between said feed roller and said separator means, and then past said thickness gauging devices; said friction separator means engaging the inner surfaces of and resisting movement of said notes being fed as said notes are driven between said feed roller and separator means, normally to separate doubles from the end notes being fed; said doubles detector means also including sensor means adapted to sense the detection of unseparated doubles by said note thickness gauging devices when doubles are driven past said note thickness gauging devices; and said sensor means when sensing the detection of doubles reversing said drive means to return said detected doubles back to said stack by reverse feed roller movement, whereupon normal drive means movement of the feed roller in forward note feeding direction is restored and said drive means again is reversed repeatedly until the doubles is separated from the end note being fed, by said back and forward note scrubbing of the doubles between said friction segment means and said friction separator means.

BRIEF DESCRIPTION OF THE DRAWINGS

A preferred embodiment of the invention—illustrative of the best mode in which applicants have applied the principles—is set forth in the following description and shown in the drawings and is particularly and distinctly pointed out and set forth in the appended claims.

FIG. 2 is a top plan view of the friction picker mechanism of the invention removed from the ATM housing;

FIG. 3 is a side elevation of the parts mechanism shown in FIG. 2;

FIG. 4 is a front end elevation view of the picker mechanism looking in the direction of the arrows 4—4, FIG. 3;

FIG. 6 is a sectional view looking in the direction of the arrows 6—6, FIG. 2;

Similar numerals refer to similar parts throughout the various figures of the drawings.

DESCRIPTION OF THE PREFERRED EMBODIMENT

Figure 20:
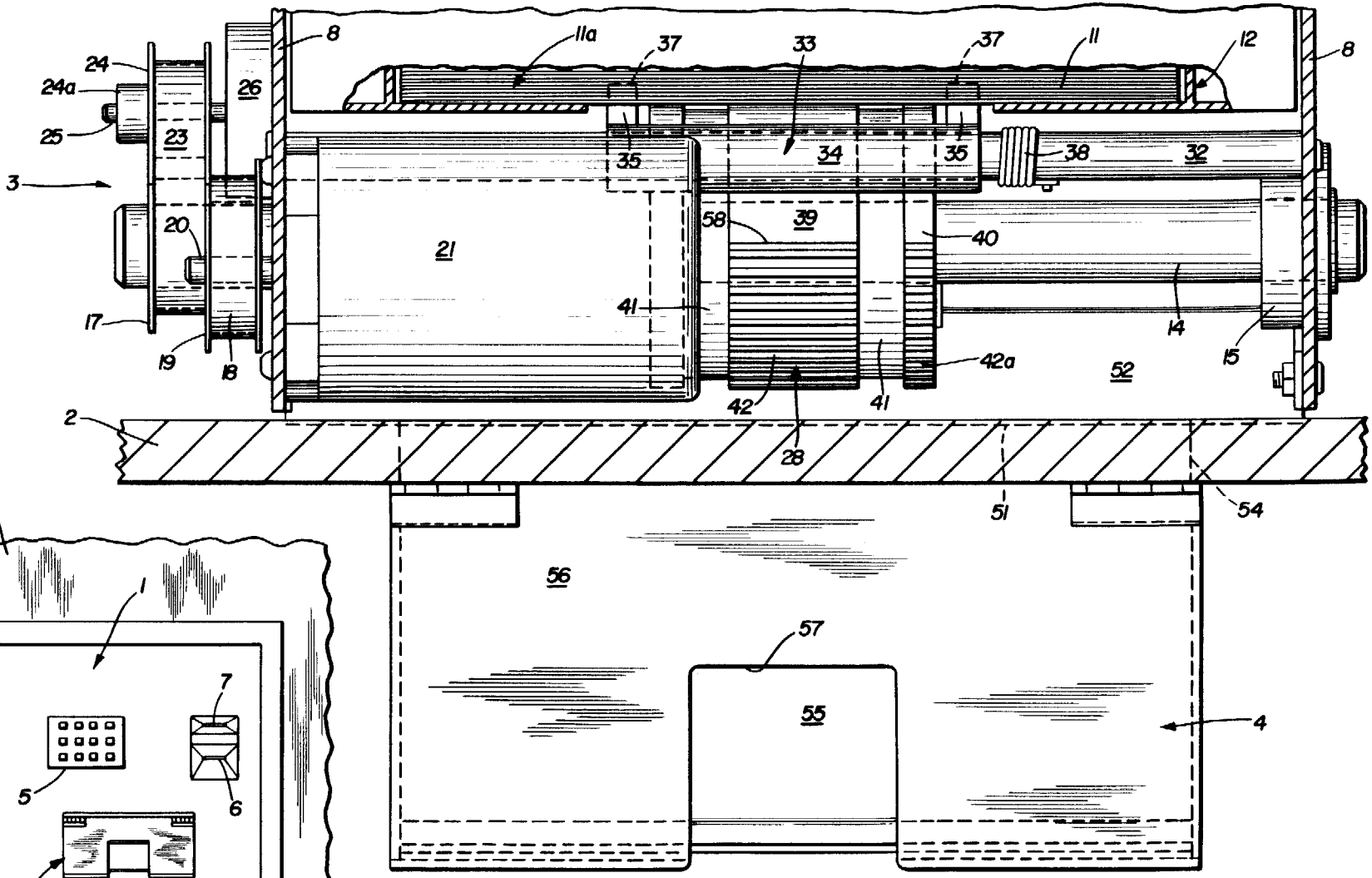
FIG. 20 is an enlarged fragmentary top plan view of the dispense end of the mechanism shown in FIG. 2, installed in an ATM as shown in FIGS. 1 and 19.
Figure 1:
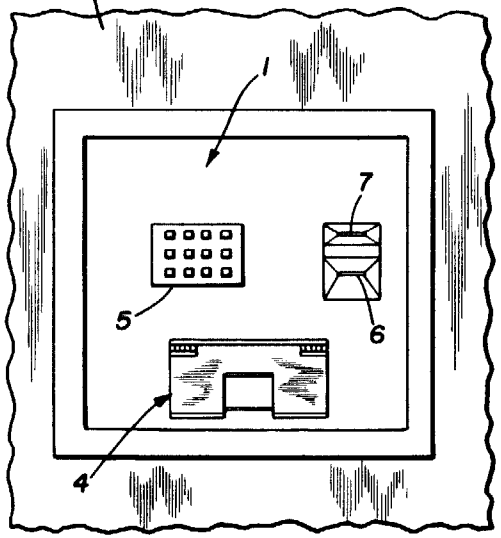
FIG. 1 is a fragmentary diagrammatic view of an ATM installed in a wall having the new friction picker mechanism.

The fascia of an ATM cash dispenser is diagrammatically indicated at 1 in FIG. 1 installed in a wall 2 of a building such as a bank or a remote banking structure. The ATM is equipped with the new friction picker mechanism of the invention as is illustrated generally at 3 in FIGS. 2, 3 and 4. The customer note delivery station for the mechanism is indicated generally at 4 in FIGS. 1 and 18 to 20.

The ATM may have a keyboard 5 for actuating the cash dispenser, a slot 6 for receiving a customer's actuating and identification card, and a receipt-issuing slot 7, all of typical ATM cash dispenser construction, and these components may be mounted on the fascia 1.

The picker mechanism 3 of the invention preferably is located in the ATM in a compartment formed by spaced side walls 8 and a bottom wall 9 assembled and tied together by one or more cross members generally indicated at 10.

The paper currency or notes 11 to be dispensed are contained in a preferably metal note container generally indicated at 12. The note container 12 may be a sealed container such as the container shown in U.S. Pat. No. 4,113,140. In this type of container the notes 11 are arranged in a stack 11A pressed toward an opening 13 through which the notes may be picked one at a time from the stack in the container.

The note container 12 is assembled with and installed in the picker mechanism 3 by sliding the container end having the opening 13 from left to right (FIGS. 2 and 3) into the picker mechanism compartment along the bottom wall 9 to the position generally illustrated in FIGS. 2 and 3. It is preferred that the container 12 should be oriented so that the stack 11A of notes 11 has the notes on edge in the container pressed against the opening 13 and with the length of the notes extending laterally or crosswise viewing FIG. 4. In this manner the notes 11 are positioned so that the widths of the notes extend generally vertically viewing FIG. 5.

The picker mechanism 3 has a main feed roller drive shaft 14 journaled at its ends in bearings 15 mounted on picker mechanism side walls 8 within the compartment containing the picker mechanism. One end of the shaft 14 (the left end FIG. 14) preferably has pulleys 16 and 17 mounted thereon. The pulley 16 is driven by a belt 18 engaged over and driven by drive pulley 19 on the extended end of drive shaft 20 of drive motor 21. The drive motor 21 is mounted by bolts 22 on the inside of left side wall 8 of the picker mechanism (FIGS. 4 and 14).

Pulley 17 drives belt 23 trained over pulley 24 mounted on a one-way clutch 24a on a shaft 25 which is connected through a speed reducer 26 with and driving a counter-rotating shaft 27 journaled at its ends in mechanism side walls 8. Speed reducer 26 preferably has a 4 to 8 to 1 typically 6 to 1 ratio between shafts 14 and 27.

Figure 14:
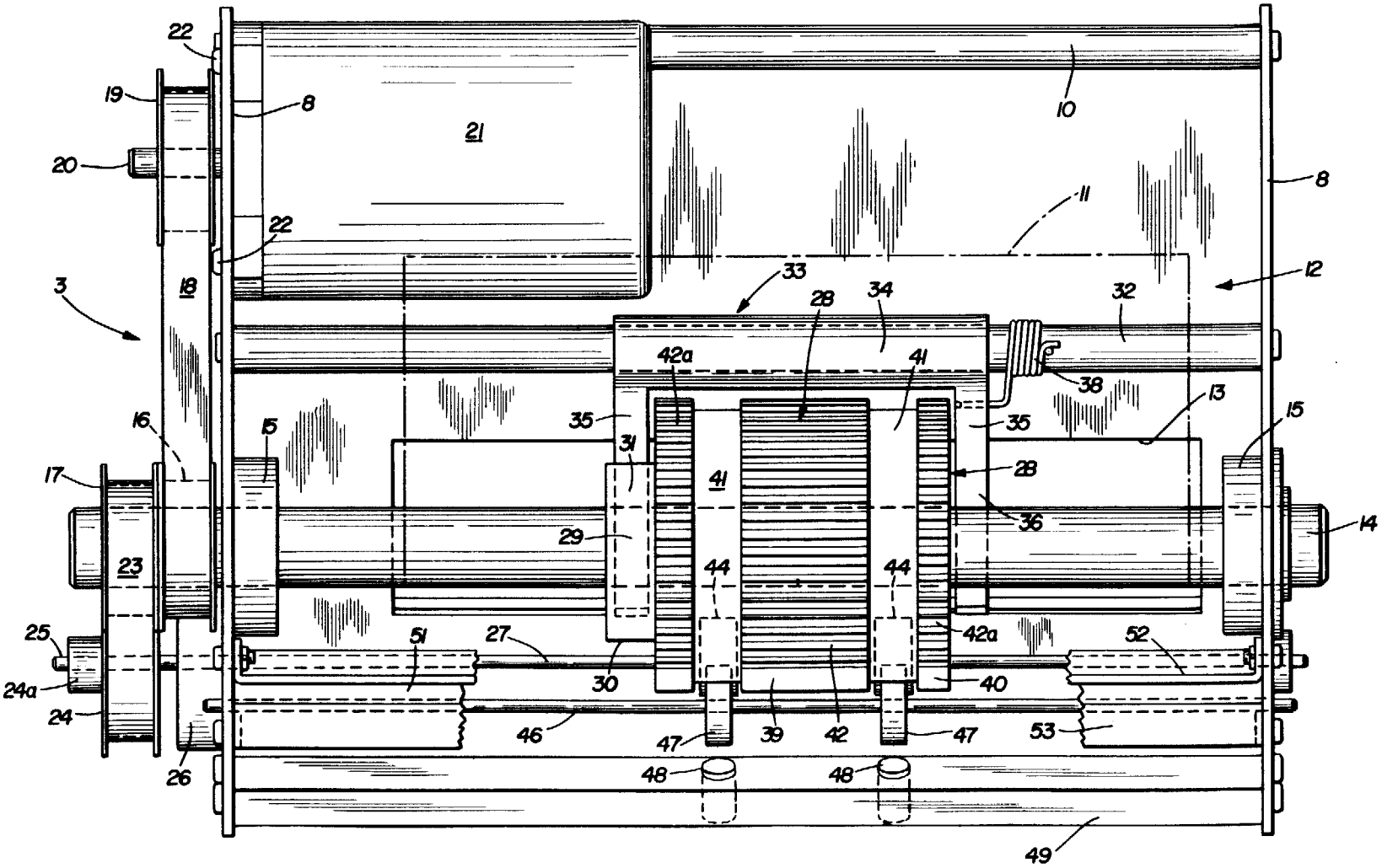
FIG. 14 is an enlarged view with parts broken away, similar to FIG. 4, illustrating the picker feed roller mechanism in the "home" position of FIGS. 11 and 15 ready to commence a picking operation cycle.

The mechanism feed roller generally indicated at 28 (FIG. 7) is fixed to main feed roller shaft 14 within the mechanism compartment intermediate the ends of the shaft 14 (FIG. 14). The feed roller 28 has a mechanism control cam 29 mounted on one end thereof. Cam 29 has a segment or lobe 30 with a circular surface concentric with the axis of main feed roller shaft 14, and a lobe 31 with a shape of varying radial location with respect to the axis of shaft 14, the purpose of which is described below.

Figure 5:
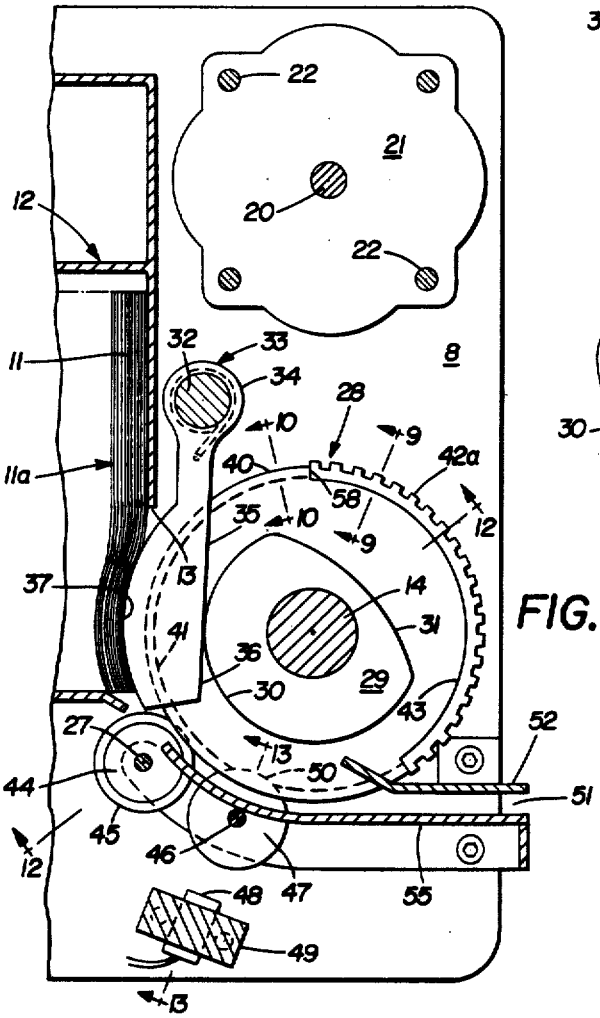
FIG. 5 is an enlarged sectional view with parts broken away looking in the direction of the arrows 5—5, FIG. 2.

A pivot shaft 32 also extends between and is journaled at its ends of the mechanism side walls 8 adjacent feed roller 28 and the end of container 12, and above both the feed roller 28 and the container opening 13 (FIG. 5).

Figure 8:
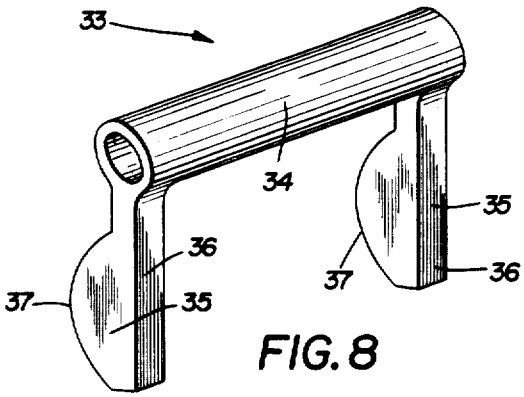
FIG. 8 is a detached perspective view of the note stack biasing lever which may be associated with the feed roller of FIG. 7.

A U-shaped lever 33 (FIG. 8) has its tubular portion 34 pivotally mounted on pivot shaft 32 with its legs 35 straddling the ends of feed roller 28. Each leg 35 of lever 33 has a preferably flat edge 36 and an opposite curved edge 37. The flat edge 36 of one of the legs 35 biased by spring 38 engages the feed roller cam 29.

When the cam segment 30 is engaged with the leg flat edge 36, as shown in FIG. 5, the curbed leg edge 37 extends through container opening 13 and pushes the note stack 11A against note stack pressure, and holds the notes 11 out of contact with the feed roller 28 as shown in FIG. 5. The at rest or "home" position of the feed roller 29 is illustrated in FIG. 5.

The feed roller 28 when rotating during a picking cycle of one revolution from and back to "home" position in a counterclockwise direction (FIG. 5) similarly rotates control cam 29, and the leg 35 initially engages the cam lobe 30 and curved leg edge 37 holds the notes 11 out of contact with the feed roller 28. As rotation proceeds and lever leg 35 comes in contact with cam lobe 31, the lever 33, biased by spring 38, releases the note stack 11A enabling the end note to contact the feed roller 28 of the stack 11A and note from the stack to be picked in the manner described in more detail below, during the extent of contact of the lever leg 37 with the cam lobe 31. As the picking cycle of one revolution of the feed roller and cam approaches termination, the cam segment 30 contacts the lever and moves the lever curved leg portion 37 toward the stack to again hold the stack 11A out of contact with the feed roller 28.

Figure 9:
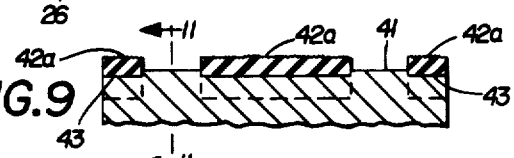
FIG. 9 is a fragmentary sectional view of the friction rubber segment portion of the feed roller looking in the direction of the arrows 9—9, FIG. 5.
Figure 10:
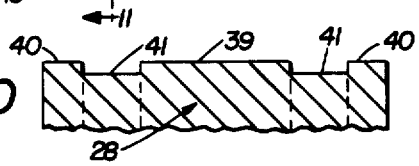
FIG. 10 is a fragmentary sectional view looking in the direction of the arrows 10—10, FIG. 5.
Figure 7:
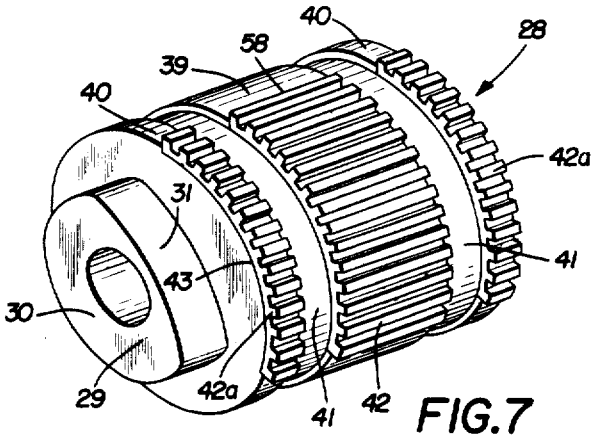
FIG. 7 is a detached perspective view of the feed roller for the picker mechanism.
Figure 11:
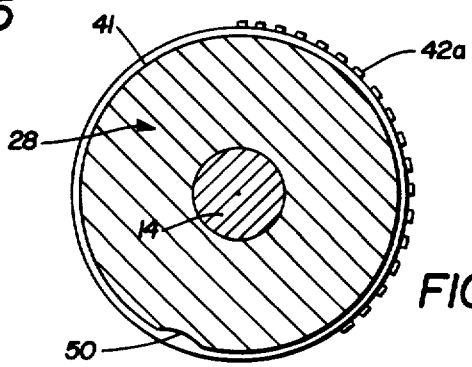
FIG. 11 is a sectional view of the feed roller taken on the line 11—11, FIG. 9, showing the feed roller construction between spaced portions of the friction rubber feed roller segment.

Referring to FIGS. 8 to 12, feed roller 28 has a smooth circular or cylindrical outer surface comprising a central extended circular or arcuate area portion 39 and narrow circular or arcuate area end portions 40 with flat circular recessed grooves 41 formed in the roller between the central area 39 and end area portions 40 (FIGS. 7, 10 and 11). The outer smooth circular feed roller areas or zones 39 and 40 are interrupted by arcuate rubber friction material segments 42 and 42a which preferably have a roughened or texture outer surface as diagrammatically illustrated. The rubber friction material preferably is mounted on or embedded in friction material retaining grooves 43 (FIG. 9).

Figure 12:
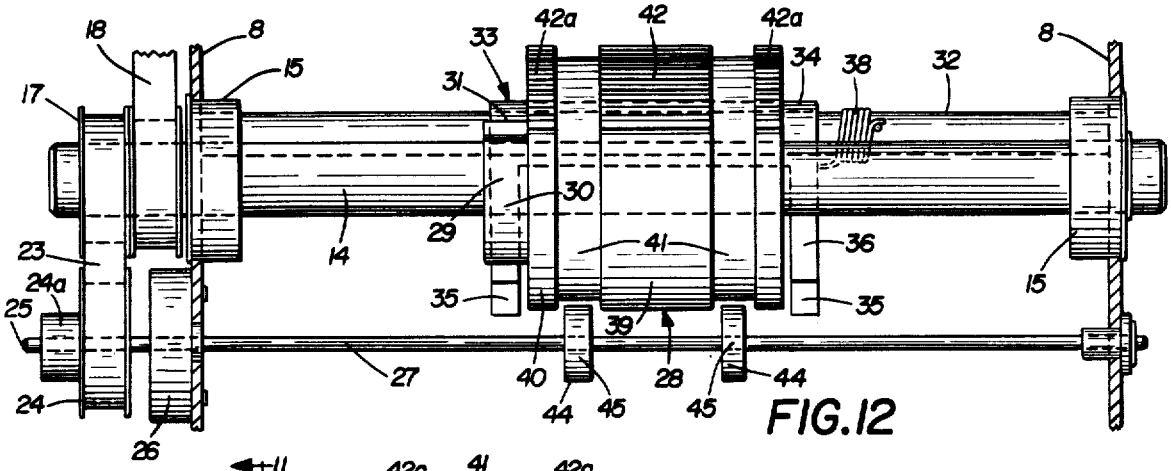
FIG. 12 is a fragmentary view looking in the direction of the arrows 12—12, FIG. 5 illustrating the relationship between the feed and counter-rotating rollers.

The counter-rotating shaft 27 (FIGS. 5, 12 and 14) has a pair of counter-rotating separator rollers 44 mounted thereon in spaced relation at locations opposite the flat feed roller grooves 41 so that the rollers 44 intermesh with but do not contact the feed roller 28 as clearly illustrated in FIG. 12 which is a sectional view taken on a plane, as indicated in FIG. 5, passing through the axes of shafts 14 and 27. This intermeshed relationship between the feed roller 28 and counter-rotating rollers 44 is described more in detail below. The rollers 44, which are narrower in width than the flat feed roller grooves 41, have an outer friction rubber material circumferential surface 45.

The new simplified friction picker mechanism of the invention also has combined therein a simplified construction for detecting the presence of doubles that may be picked.

Although the mechanism is designed in normal operation to separate notes in the stack 11A beneath the end note and to pick and discharge only the end note, nevertheless, for any one of a number of reasons, one or more notes may stick or otherwise adhere to the end note when being picked. This accounts for the inclusion of doubles detection means as a cooperative and interrelated part of the mechanism.

Figure 13:
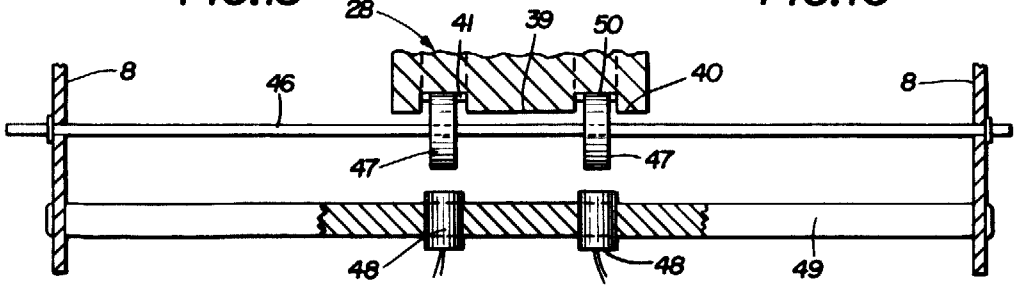
FIG. 13 is a fragmentary view similar to FIG. 12 looking in the direction of the arrows 13—13, FIG. 5, illustrating the thickness gauging and doubles detecting sensor devices forming a part of the new friction picker mechanism.

A thickness gauging shaft 46 for this purpose is mounted at its ends on mechanism side walls 8 (FIGS. 13 and 14) close to and spaced counterclockwise from the counter-rotating shaft 27 (FIG. 5). A pair of note thickness gauging rollers 47 are mounted on shaft 46 in spaced relation at locations also opposite the flat feed roller grooves 41 so that the gauging rollers 47 have roller contact with the flat feed roller grooves 41 as shown in FIG. 13.

The gauging shaft 46, as shown, has a small diameter in cross section as compared with the very large cross-sectional diameter of the feed roller shaft 14 (FIG. 14). This permits note thickness gauging procedure to be carried out in accordance with procedures shown particularly in FIGS. 7 and 8 of and described in U.S. Pat. No. 4,154,437, incorporated herein by reference.

When the mechanism is assembled, the shaft 46 has an initial bend formed therein between its end supports; with the gauging rollers 47 riding in and pressed by the bend against the feed roller grooves 41.

Figures 18, 19, 21:
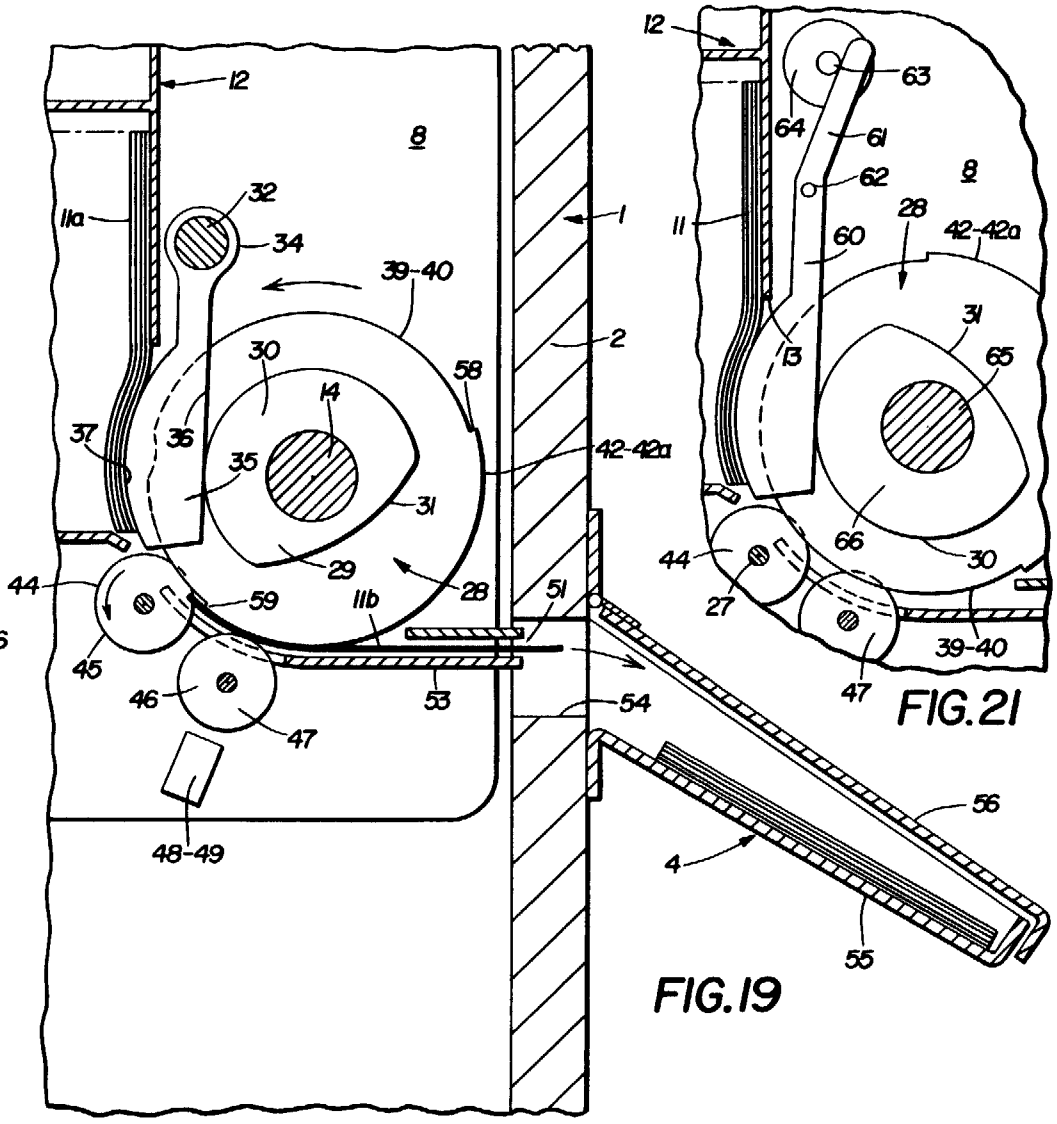
FIG. 18 is a view similar to FIGS. 15 through 17 showing a further stage in the feeding cycle with the friction segment driving the note past the counter-rotating roller and doubles detect roller toward the dispense channel communicating through an ATM housing wall to the customer delivery station.
FIG. 19 is a view similar to FIG. 18 showing the final cycle stage of discharging a note to the ATM customer delivery station.

Thus, as a note is picked and is fed between feed rollers 28 and gauging rollers 47 as illustrated in FIG. 19, shaft 46 is deflected to increase the bend therein in accordance with the note thickness. Such shaft bend is increased if a doubles is picked and passed between rollers 28 and 47.

This shaft deflection occurring during the thickness gauging operations described may be sensed by proximity sensor means 48 mounted on a bar 49 extending between side walls 8 of the mechanism.

The proximity sensors 48 of known construction may have four states, stages, phases or modes. The first mode being that when the feed roller 28 is located at home position as shown in FIG. 5. At this time at least one of the gauging rollers 47 contacts a notch 50 (FIG. 11) in the feed roller and provides minimum bending to the gauging shaft 46. This is the sensor "at home" mode.

The second mode is determined by the increased bend in shaft 46, when the rollers 47 ride in the feed roller grooves 41 with no notes being gauged. This is referred to as the "no-note" mode.

When a single note is being picked normally and passes between the rollers 28 and 47, the bend in shaft 46 is increased from that of the "no-note" mode, and this increase is sensed by sensors 48 and may be referred to as a "single note" mode, the third of the four modes sensed.

When a doubles or even more than two notes are passed between rollers 28 and 47, shaft 46 will be bent or deflected even further. Such increased bend is sensed by sensors 48 as a fourth mode which may be referred to as a "multiple note" mode.

In this manner, the sensors 48 not only sense no-notes, a single note, and more than one note or a doubles; but also sense when the feed roller 28 is in home position, that is, at the beginning of one cycle of operation occurring during one revolution of the feed roller 28. Thus, the sensors act as cycle sensors in addition to acting as doubles detect sensors.

Notes as they are picked, normally one note per cycle, are discharged or ejected rapidly by the feed roller into a delivery slot 51 preferably formed between top and bottom plates 52 and 53 located below the feed roller 28 and beyond the gauging rollers 47 (FIGS. 5 and 15–19). The delivery slot 51 may terminate at an opening 54 in the building wall 2 or fascia 1 communicating with the customer delivery station 4.

The customer delivery station may have an angled troughlike bottom wall 55 covered by a hinged lid 56. The lid 56 may have a central cut out portion 57 for ease in grasping dispensed notes from the troughlike bottom wall while only slightly opening the lid 56 and also for visibility of notes that have been dispensed.

The rapid rotation of the feed roller 28 in normally picking and dispensing notes imparts a high velocity to the dispensed notes sufficient to deliver the notes through the delivery slot 51 and into the angled troughlike member 55 of the delivery station 4. The delivery slot surfaces of plates 52 and 53 may be coated to provide very smooth surfaces so as not to decelerate note discharge movement. Nylon slide members, not shown, may be located on the slot surface of bottom delivery slot plate 53 if desired.

The drive motor 21 for the friction picker mechanism is a reversing motor and preferably may be a Stepper Motor product of Bodine Electric Company of 2500 W. Bradley Place, Chicago, Ill. 60618, Catalog ST-1, Type 23T Motor. Stepper Motors are controlled by programming which instructs the motor how many steps to move, by voltage impulses, plus or minus, forward or backward.

The length of movement of a step may be fixed for a particular motor. For example, such stepper motor used as a drive motor 21 for the friction picker mechanism of the invention may have a step movement of three degrees rotation of the feed roller 28 per step, so that the motor 21 delivers 120 steps in a picking cycle of feed roller operation. Such one revolution picking cycle of the mechanism picks and delivers one note per cycle.

In usual operation of an ATM cash dispenser, the customer may call for say ten notes of the particular denomination stacked in a note container. Accordingly, when the ATM is actuated, the stepper motor 21 is instructed to drive the feed roller 28 for ten cycles thus delivering ten notes, one per cycle of operation.

Details of a picking cycle of operation are illustrated diagrammatically in FIGS. 15 through 19.

Figure 15:
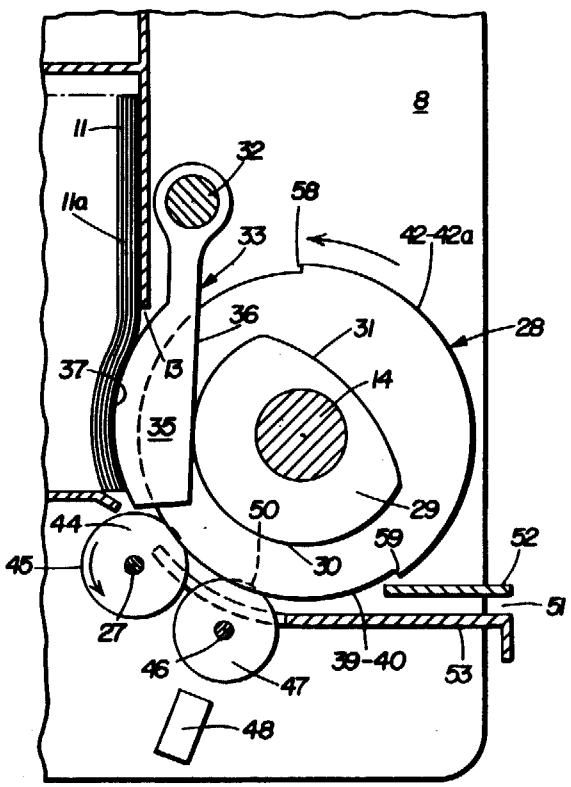
FIG. 15 is a diagrammatic view similar to portions of FIG. 5 showing the feed roller in "home" position ready to start a picking operation cycle.

A picking cycle starts with the feed roller 28 at the "home" position described, such as shown in FIGS. 6, 11 and 15 with the leading edge 58 of the rubber friction segment 42 of feed roller 28 of the mechanism at rest and motor 21 is energized.

FIGS. 15 through 19 diagrammatically illustrate certain features of the mechanism; for example, the friction segment 42 is illustrated by an arcuate line in each of the views slightly greater in diameter than the circular line defining the smooth circular outer surface portion 39 of the feed roller.

The leading edge 58 of the friction surface is indicated by a shoulder between arcuate line 42 and smooth circular surface 39; and similarly the trailing edge of arcuate segment 42 is indicated by a shoulder 59.

Further, the reference to the arcuate rubber friction material segment 42, collectively includes the narrow segment portions **42*a*, and the main friction segment 42 which is centrally located between the flat grooves 41. The narrow segment portions 42*a* are located outside of said groove 41 and are interrupted from central portion 42** by said grooves.

This relationship provides a total axial length of the feed roller friction surface portions 42 and **42*a* considerably greater than the cross-sectional combined axial lengths of the grooves 41** which, in effect, is twice the width of one of the grooves.

Also, in FIGS. 15 through 19 the counter-rotating roller 44 and the gauging roller 47 each are shown by circles slightly intersecting the circular portion 39 which defines the smooth outer surface of the feed roller 28 because of the relative locations of the indicated components as illustrated in FIGS. 12 and 13. In FIG. 12, the counter-rotating rollers 44 are intermeshed with the grooves 41 in feed roller 28 but do not contact the feed roller. In FIG. 13, the gauging rollers 47 are shown in rolling engagement with the flat recessed surfaces of grooves 41 in order to perform the gauging and doubles detect functions described.

Returning now to FIG. 15 and to the "home" position of the parts illustrated, at the time when the drive motor 21 is energized, the curved edge 37 of lever 33 is holding the note stack 11A out of contact with the smooth portion 39 of the feed roller. This relationship continues as the feed roller rotates counterclockwise to the position shown in FIG. 16.

Meanwhile, the circumferential friction surface of the counter-rotating rollers 44 are intermeshed with but out of contact with the feed roller grooves 41.

Figure 16:
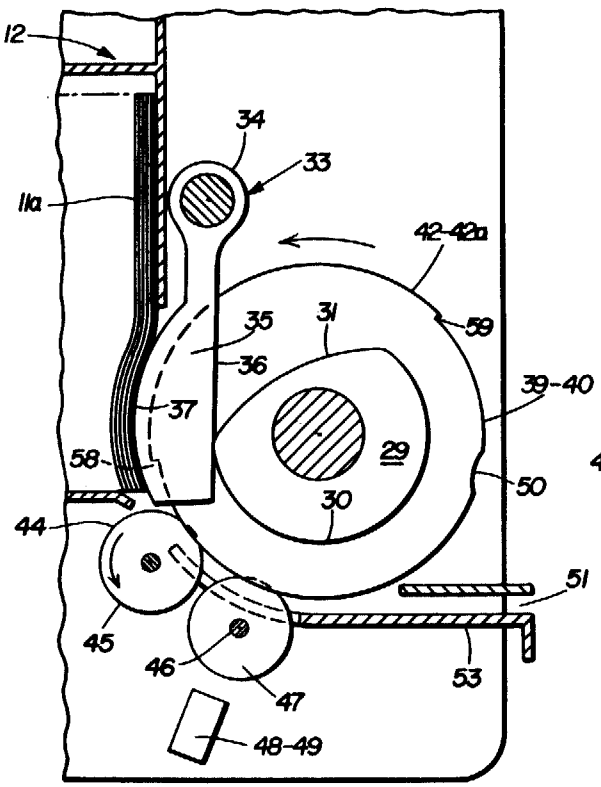
FIG. 16 is a view similar to FIG. 15 with the feed roller rotated through an initial cycle portion to a position ready for its rubber friction segment to engage the outer note of a stack which is held out of engagement with the rubber friction segment by the note stack biasing lever.

When the parts reach the positions shown in FIG. 16, the leading edge 58 of the feed roller friction segment 42 arrives generally opposite the location of the lower edges of the notes in stack 11A and approaches intermeshing status of friction surface of feed roller and the friction surface of the counter-rotating rollers 44.

Figure 17:
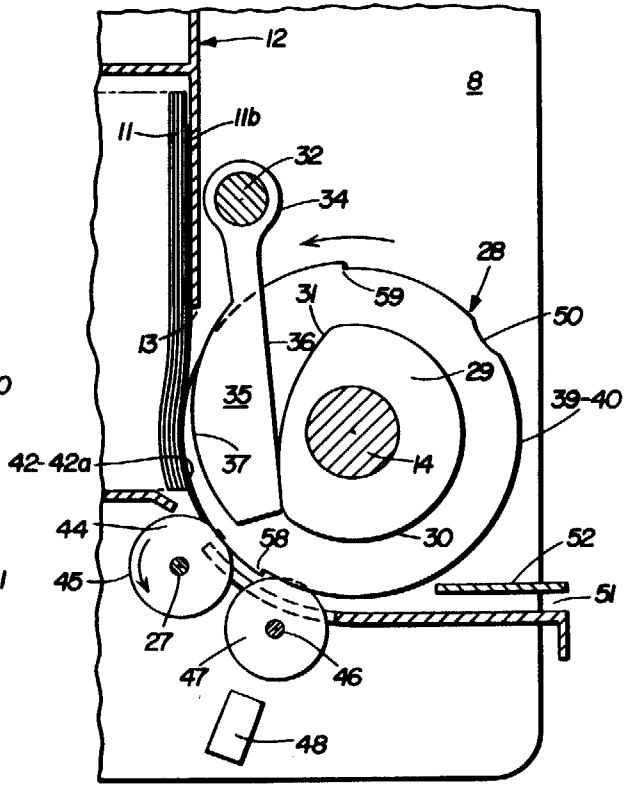
FIG. 17 is a view similar to FIG. 16 illustrating the biasing lever disengaged from the note stack, enabling the feed roller friction segment to engage and drive the outer stack note from the stack.

As the feed roller continues to rotate to the position of FIG. 17, the cam lobe 31 releases lever 33 and the feed roller friction segment 42 engages the end note of the stack 11A and by frictional engagement pulls that note from the stack as indicated by the heavy line displayed note 11B in FIG. 17.

Continued rotation of the feed roller 28 drives the note 11B past the counter-rotating roller 44 and past the doubles detect gauging roller 47 as shown in FIG. 18.

As the feed roller continues rotation from the position of FIG. 18 to that of FIG. 19, the picked note 11B is discharged and the lever 33 is then moved by cam lobe 30 to hold the stack 11A out of contact with the feed roller. The feed roller then completes its cycle of operation and returns from the position of FIG. 19 to that of FIG. 15, having picked one note.

The construction of the picker mechanism is intended to avoid picking more than one note from the stack 11A at a time. This is accomplished normally by the cooperative action of the counter-rotating roller 44. If during a picking cycle one or more notes next underneath the end note of the stack commence to emerge from the stack as a note 11B is being picked as described, the circumferential friction surfaces of the intermeshed counter-rotating rollers 44 engage the note or notes trying to emerge between the note being picked and move such additional notes back into the stack.

The action of the counter-rotating rollers 44, however, is not sufficient to impede or prevent the frictional segment engaged end note of the stack from being picked.

The condition producing this result is that the frictionengaging force of the feed roller friction segment 42 exerted on the outer surface of the stack end note is greatly in excess of that of the rollers 44 on the note inner surface. First of all, the zone of contact of the segment 42 with the note outer surface, as described above, has a greater length than the frictional surface zone of contact of the two narrow width counter-rotating rollers 44. Whether these zones of contact with the note by frictional areas of the rollers 28 and 44 are line contacts or are wider than line contacts because the note may be contacted by curved surfaces of the rollers, is beside the point, since ultimately the respective contact lengths of line or wider than line zones, as stated, are much greater for the feed roller friction surface area.

Increasing the effect of such feed roller friction force is the larger diameter of the friction roller 28 as compared with that of the counter-rotating rollers 44, plus the fact that the speed of rotation of the feed roller 28 is considerably greater than that of the counter-rotating rollers 44.

Further, the note 11B being picked is driven between the feed roller 28 and the note thickness gauging rollers 47 and is pinched between said rollers which aids in continuing to drive the note in note feeding direction, irrespective of any resistance at the trailing portion of the note exerted by the friction separator means, that is, the counter-rotating rollers 44.

These characteristics normally enable one note to be picked at a time for each cycle of note-picking operation and when a number of notes are to be picked in succession, the spacing between successive notes is automatically maintained the same so that the notes are discharged at a uniform rate into the customer delivery station 4.

The operation of the mechanism is described below that results if some abnormal condition is detected by movement of a note thickness gauging roller away from the feed roller indicating that more than one note thickness had been found. The abnormal condition may be one of numerous kinds, such as the known tendency of notes in a stack of new notes to stick together, or such as the actual presence of adhesion between two notes due to the accidental presence of a sticky substance transferred to a note by a previous note handler, or such as a portion of one note being folded about the end of another note.

When such increased note thickness is gauged by actuation of the thickness gauging rollers 47, the sensors 48 through typical control circuitry of known types used in ATMs which may include a programmed microprocessor, transmit a signal to the stepper motor directing it to stop and reverse its drive movement for the same number of steps that have been fed to the feed roller 28 in its forward motion. This drives the note or notes whose thickness has been gauged, in a reverse direction back into the stack by the reverse action of the feed roller friction segment 42.

As the drive for the mechanism is reversed to enable the feed roller 28 to drive the abnormal thickness note collection back into the stack, the counter-rotating rollers 44 are not reversed due to the action of the one-way clutch **24*a* present in the drive system for the shaft 27 on which the counter-rotating rollers 44 are mounted (FIGS. 12 and 14**).

In other words, pulley 24 is mounted on the one-way clutch **24*a* in turn mounted on shaft 27, so that when feed roller 28 is driven in note feeding direction, counter-rotating rollers 44 are driven in a reverse direction. However, when the drive for the feed roller 28 is reversed, the one-way clutch 24*a* overruns, and the rollers 44** are not driven in a reverse direction.

After the stepper motor 21 has reversely driven the feed roller 28 for the same number of steps that the feed roller had been advanced, the stepper motor stops and automatically again reverses to normal forward driving of the feed roller. Ordinarily the drive motor reversal described corrects the abnormal condition and feeds a single note. If such normal feeding does not occur during the first drive motor reversal, the reversals are repeated until the abnormal thickness condition disappears and separation of notes and normal feeding and picking thereof is reestablished.

Such repeated reversals of feed roller movement to correct an abnormal thickness condition involves back and forward note scrubbing of the abnormal thickness notes between the friction segment 42 and the friction separator devices or rollers 44. This repeated back and forward movement, of course, is a result of the repeated reversed movement of the feed roller 28.

This cooperative and coordinated relationship between the simple reversing motor drive, the feed roller with a friction segment, the counter-rotating friction rollers, and the thickness gauging rollers, provides a new and unique result. This result eliminates problems heretofore present in ATMs relating to the manner in which doubles are detected, handled, transported and stored. Thus the new mechanism eliminates doubles diversion and transporting doubles to a divert container, and also eliminates a divert container and its protective measures.

In the unusual circumstance that the back-and-forth movement of detected doubles to and from the stack fails to separate the notes involved and fails to establish normal picking operation of notes, one at a time, from the stack, after a predetermined series of reverse operations the number of which may be programmed into the mechanism control, the abnormal thickness note group may be fed to the customer discharge station 4, and the note status recorded in accordance with The Method of and System For Detecting Bill Status Such as Single Bill, Double Bills, and Folded or Overlapped Bills in a Paper Money Dispensing System described in said application Ser. No. 309,022, assigned to the Assignee of the present invention, and incorporated herein by reference in its entirety.

The simplified construction and operation of the new friction picker mechanism of the invention permits convenient location of the mechanism adjacent an end of a container for the supply stack of notes to be picked, and adjacent an ATM fascia so that no transport mechanism is required for delivery of the picked notes one at a time to the customer delivery station.

However, this beneficial result does not preclude the new friction picker mechanism of the invention from being used in ATM constructions where some means of conveying dispensed notes may be desired to present the notes at a location remote from the picker, for example, for combining the notes with other denomination notes picked from other supply stacks.

Figure 22:
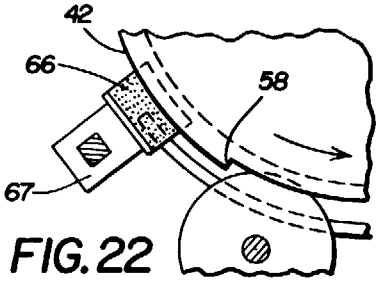
FIGS. 21 and 22 are diagrammatic views showing slightly modified form of construction of the biasing lever and separator means.

Although the preferred form of note separator means shown and described comprise counter-rotating friction-surfaced rollers 44, rubber pads 66 may perform the same separating functions when located on pad holders 67 fixed at the position occupied by rollers 44 with such pads directed toward and intermeshed into the feed roller grooves 41 so as to provide frictional resistance directed toward the inside of the end note being picked. Such pads, like rollers 44 have frictional resistance of a smaller magnitude of frictional force applied toward the inside of the end note being picked by the feed roller friction segment 42, than the segment frictional picking force, (FIG. 22).

Another preferred characteristic of the mechanism is that the arcuate length of the rubber friction material segment of the feed roller is approximately equal to the note width. This is desirable in positioning the components of the cash dispenser in an ATM from the standpoint of minimizing the required vertical dimension of the housing compartment of the ATM to give flexibility in locating at a most convenient position, the customer delivery station.

The manner in which the rubber friction material segment portions 42 and **42*a* are mounted on the feed roller 28 in retaining grooves 43** is desirable in order to permit simple replacement or renewal of the rubber when it becomes worn.

A slightly modified construction is illustrated in FIG. 21 wherein the stack hold-back lever 60 normally is located in holding position shown by a lever arm 61 projecting upward from the lever pivot axis 62 for engagement with an armature 63 of a solenoid 64.

Such construction may be used with a drive motor which continuously rotates the feed roller shaft 65. Normally the solenoid armature 63 holds the lever 60 in the position shown, to which the lever is moved in normal operation by the cam 66. When the mechanism is directed to dispense one or more notes, the solenoid armature 63 is withdrawn permitting the friction picker to operate in the manner described and to pick the number of notes called for. The drive motor for the optional continuous rotation of the feed roller may be either a stepper motor as described, or a typical reversing motor.

The feed roller element having the described construction with grooves and friction material segments is preferably made either of metal or of plastic material.

The rubber used for the feed roller rubber friction material segments, and for the surface of the counter-rotating roller, preferably is urethane rubber.

The proximity sensors 48 preferably are a product of Electro Corporation, P.O. Box 3049, 1845-57th, Sarasota, Fla. 33578, Type No. PA-12D-43.

The new picker mechanism has been described as including the use of the lever 33 (FIG. 8) or lever 60 (FIG. 21) to hold back the stack notes from contact with the feed roller 28 except when the friction segment 42 is actually engaged with and picking a note.

This arrangement is preferred where the stack of notes contains a random arrangement of new and old notes or all old notes. When the stack of notes contains only new notes, the lever hold-back arrangement may be omitted.

The hold-back system avoids possible limp, worn note pile-up from note contact under pressure with the smooth feed roller surface portion during rapid one note per cycle picking operations. When only new notes are involved the smooth feed roller surface portion easily slips over new note surfaces.

Accordingly, the new picker mechanism, construction and operation satisfy the stated objective; avoid problems that have arisen in the past with prior art picker mechanisms of either the friction or suction types; enables notes to be picked one at a time and the handling of doubles to be eliminated since doubles are returned to the stack in normal mechanism operation; provides a low-cost picker mechanism construction which has low maintenance costs; and thereby satisfy needs existing in the field of ATMs.

In the foregoing description, certain terms have been used for brevity, clearness and understanding but no unnecessary limitations are to be implied therefrom beyond the requirements of the prior art because such terms are used for descriptive purposes and are intended to be broadly construed.

Moreover, the description and illustration of the invention is by way of example, and the scope of the invention is not limited to the exact details shown or described.

Having now described the features, principles and cooperative relationships of the new structures, and the advantageous, new and useful results obtained, the new structures, devices, components, elements, arrangements, parts, combinations and relationships are set forth in the appended claims.

We claim:

1. Friction picker mechanism for an ATM paper note dispenser of a type in which notes at the end of a note supply stack normally pressed toward said mechanism are separated and picked one at a time from said stack by associated friction areas of a rotatable feed roller and friction separator means when said roller is driven in note feeding direction by drive means; wherein the improvement comprises:

(a) a rotatable feed roller having a smooth cylindrical surface provided with arcuate rubber friction segment means interrupting said smooth surface;

(b) rubber friction separator means directed toward and free of contact with said feed roller;

(c) doubles detector means including note thickness gauging devices located adjacent said separator means and engaged with and actuated by notes as said notes are fed by said feed roller;

(d) reversible drive means operatively connected with said feed roller which drive means when energized normally drives said feed roller in note feeding direction with said friction segment means engaging and picking stack end notes and driving said notes one at a time successively between said feed roller and said separator means, and then past said thickness gauging devices;

(e) said friction separator means engaging the inner surfaces of and resisting movement of said notes being fed as said notes are driven between said feed roller and separator means, normally to separate doubles from the end notes being fed;

(f) said doubles detector means also including sensor means adapted to sense the detection of unseparated doubles by said note thickness gauging devices when doubles are driven past said note thickness gauging devices; and (g) said sensor means when sensing the detection of doubles reversing said drive means to return said detected doubles back to said stack by reverse feed roller movement, whereupon normal drive means movement of the feed roller in forward note feeding direction is restored and said drive means again is reversed repeatedly until the doubles are separated from the end note being fed, by said back and forward note scrubbing of the doubles between said friction segment means and said friction separator means.

2. The construction defined in claim 1 in which said doubles detector means note thickness gauging devices are rollers engaged with and rotated by said feed roller.

3. The construction defined in claim 2 in which said sensor means are proximity sensors.

4. The construction defined in claim 1 in which said reversible drive means is a reversing stepper motor.

5. The construction defined in claim 1 in which said drive means continuously rotates said feed roller.

6. The construction defined in claim 1 in which said feed roller has a plurality of axially spaced annular grooves formed therein; and in which said rubber friction separator means is intermeshed with said friction segment by extending said separator means into said annular groove free of contact with said feed roller to retard feed movement of notes beneath said stack end note being picked by said friction segment means.

7. The construction defined in claim 6 in which said rubber friction separator means are counter-rotating separator rollers provided with cylindrical rubber friction surface means.

8. The construction defined in claim 6 in which said rubber friction separator means comprises a fixed spaced pair of rubber friction pads directed into said feed roller annular grooves.

9. The construction defined in claim 1 in which lever means are pivotally mounted adjacent said note stack and feed roller; in which cam means are operatively connected to said feed roller and engaged with said lever means so that said lever means pushes said stack against stack pressure away from said stack normally to hold said stack out of contact with said feed roller; in which said cam means during driven feed roller rotation releases lever hold of said stack permitting said rubber friction segment means to engage the outer surface of the stack end note at the time when said friction segment means has rotated to a position to engage said end note, and thereby to drive said end note in note feeding direction from said stack during continued feed roller rotation.

10. The construction defined in claim 9 in which the area of contact of said friction segment with said outer note surface is greater than the area of contact of said friction separator means surface with the inner surface of said note, as said note is driven between said intermeshed feed roller and separator means, whereby said end note is picked from said stack and discharged from said feed roller by said mechanism.

11. The construction defined in claim 10 in which said separator means separates any note beneath said end note tending to be picked from said stack as a doubles and returns said doubles to said stack while said end note is being picked from said stack and driven in note feeding direction.

12. The construction defined in claim 5 in which the feed roller is stopped at its "home" position in its cycle of operation.

13. The construction defined in claim 6 in which the picker mechanism includes a note thickness gauging roller in rolling engagement with a circular groove in said feed roller; in which an indexing recess is formed in said groove; and in which when said thickness gauging roller engages said indexing recess said sensor means is enabled to stop the feed roller in "home" position.

14. The construction defined in claim 4 in which the picker mechanism also includes note doubles detect means through which said sensor means is operatively associated with said feed roller; and in which said sensor means, upon detection of doubles by said doubles detect means, reverses said drive means to reverse feed roller movement.

15. The construction defined in claim 1 in which the feed roller is a metal feed roller.

16. The construction defined in claim 1 in which said feed roller has a plurality of axially spaced annular grooves formed therein; in which said arcuate rubber friction segment is divided by said annular grooves to form a wide central and narrower spaced axially extending end portion; and in which the combined axial length of said segment central and end portions is greater than the combined axial length of said groove widths.

17. The construction defined in claim 10 in which the friction segment means and the counter-rotating roller friction surface means are intermeshed by said counter-rotating roller means extending into said annular grooves free of contact with said feed roller.

18. The construction defined in claim 11 in which the picker mechanism also includes note doubles detect means having note thickness gauging rollers; and in which said thickness gauging rollers extend into and rotatably engage said annular grooves.

19. The construction defined in claim 1 in which doubles detect means is operatively associated with said feed roller; in which when a doubles is detected said doubles detect means reverses the drive means; and in which when said drive means is reversed said feed roller returns the detected doubles to the supply stack of notes.

20. The construction defined in claim 19 in which said drive means continuously rotates said feed roller; and in which said lever means is restrained from releasing its push on said stack and its holding of said stack out of contact with said feed roller until such mechanism is enabled to pick notes from said stack.

21. The construction defined in claim 20 in which said lever means is restrained by solenoid holding means; and in which said lever means is released by said solenoid holding means when the mechanism is enabled to pick notes from said stack.

* * * * *